US006363640B1

(12) United States Patent
Flum et al.

(10) Patent No.: US 6,363,640 B1
(45) Date of Patent: Apr. 2, 2002

(54) METHOD AND APPARATUS FOR CHANGING THE APPEARANCE OF A DISPLAY MERCHANDISER

(75) Inventors: Paul L. Flum, Ladue, MO (US); Christopher C. Bidwell, Dunwoody; Lionel D. Gillespie, Atlanta, both of GA (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/334,350

(22) Filed: Jun. 16, 1999

(51) Int. Cl.[7] ..... G09F 7/02
(52) U.S. Cl. ..... 40/539; 40/538
(58) Field of Search ..... 40/538, 539; 211/186, 211/189

(56) References Cited

U.S. PATENT DOCUMENTS

| | | | | | |
|---|---|---|---|---|---|
| 2,899,765 | A | * | 8/1959 | Fuller | 40/538 X |
| 4,153,311 | A | * | 5/1979 | Takahashi | 211/186 X |
| 4,164,287 | A | * | 8/1979 | Muller et al. | 211/186 X |
| 5,561,930 | A | * | 10/1996 | Ashley et al. | 40/538 |
| 5,782,027 | A | * | 7/1998 | Gildea | 40/538 |
| 6,061,939 | A | * | 5/2000 | Gildea | 40/538 |

* cited by examiner

*Primary Examiner*—Anthony Knight

(74) *Attorney, Agent, or Firm*—Blackwell Sanders Peper Martin

(57) ABSTRACT

A method and apparatus for changing the appearance of a display merchandiser so as to resemble the appearance of a particular object, the method and apparatus including providing a plurality of sheet-like members which are attachable to selected portions of the display merchandiser in a particular manner such that, when the sheet-like members are attached to the display merchandiser, such sheet-like members interact with the merchandiser and with each other to form a three-dimensional representation of the particular object. Each sheet-like member is shaped and dimensioned to represent the appearance of a portion of the particular object, some of the sheet-like members being attachable to at least some of the elongated support members associated with the display merchandiser and at least one of the sheet-like members being attachable to the uppermost shelf member of such merchandiser. In one embodiment of the present invention, some of the sheet-like members are foldable and assemblable around various elongated support members so as to substantially encircle the same, whereas in another embodiment at least some of the sheet-like members are adhesively attachable directly to the elongated support members. The present sheet-like members can be formed in a wide variety of different shapes and configurations to simulate the appearance of a wide variety of different objects such as a bottle, a spaceship, animal or cartoon characters, or any other envisioned representation and such sheet-like members can be constructed for use with a wide variety of differently shaped display merchandisers.

33 Claims, 6 Drawing Sheets

METHOD AND APPARATUS FOR CHANGING THE APPEARANCE OF A DISPLAY MERCHANDISER

TECHNICAL FIELD

This invention relates generally to product merchandising display fixtures and, more particularly, to a method and apparatus for transforming the appearance of a conventional display merchandiser into a three-dimensional representation of a wide variety of different objects so as to attract consumer attention and promote sales.

BACKGROUND OF THE INVENTION

Numerous product merchandising display systems and other point-of-purchase devices including modular display fixtures have been designed and manufactured for use in merchandising a wide variety of different types of products including bottled products such as soft drink products to consumers. These display devices are commonly employed in supermarkets, convenience stores, grocery outlets, drug and liquor stores, fast food outlets and a wide variety of other wholesale and retail stores for use in store display windows, end-of-aisle merchandising areas, lobby and checkout areas, and other high traffic areas to show and focus attention on the products and wares displayed therein. It is not only the strategic location of a particular display merchandiser which is important in a particular merchandising application, but it is often times the ability of such merchandiser to catch the eye of a prospective consumer which ultimately leads to an eventual sale. This is true because the sale of many products occur impulsively and opportunistically if consumers are directed, for whatever reason, to a particular merchandising display. Consumers are heavily influenced by displays and a large percentage of brand name decisions are made in the store.

As a result, merchants and vendors are always attempting to enhance the appearance of conventional display merchandisers such as multi-tiered display units having a plurality of shelves vertically stackably arranged in spaced apart relationship one above the other so as to more readily attract consumers to the such displays. Such enhancements often times include elaborate header boards, product graphics, and other signage specifically directed to attract and focus consumer attention on the particular merchandising display. It is therefore desirable to have a transformation system available to merchants and vendors for easily converting a conventional, ordinary looking vertically arranged display unit into an eye catching point-of-sale merchandiser which will more readily attract prospective shoppers and buyers to the display and to the particular products displayed therein.

Accordingly, the present invention is directed to overcoming one or more of the problems typically encountered in attempting to enhance the overall appearance of a particular display merchandiser.

DISCLOSURE OF THE INVENTION

The present invention teaches a transformation technique for changing the overall appearance of a product merchandising display unit wherein a plurality of sheet-like members are foldable and attachable to various portions of the display unit in a particular manner such that, when attached to the unit, such sheet-like members form a three-dimensional representation of a particular object such as a bottle, a spaceship, an animal character, or any other envisioned representation. In this regard, the sheet-like members are individually shaped and configured such that when attached to the appropriate portions of the particular display unit in question, such sheet-like members interact with the display unit, and with other sheet-like members, to produce the appearance of a particular object. Such interaction typically takes the form of the sheet-like members being attachable to one or more of the upright support members or elongated poles positioned between the plurality of vertically spaced shelf members associated with a particular display unit as well as with the uppermost shelf member of such unit. Other attachment locations such as attachment to other shelf members forming the display unit are likewise recognized and anticipated depending upon the size and shape of the particular display unit in question as well as the particular application desired.

In one embodiment of the present invention, at least some of the sheet-like members are foldable and assemblable around the various upright support members so as to substantially encircle the same, whereas in another aspect of the present invention, at least some of the sheet-like members are adhesively attachable directly to at least one surface portion associated with a particular upright support member. In addition, the individual sheet-like members can be shaped and designed so as to achieve a three-dimensional representation of an object regardless of the particular shape and/or size of the display unit. For example, the display unit may be rectangular, square or circular in shape and the upright support members may likewise take on a wide variety of different shapes and configurations such as square, rectangular, triangular and/or circular. As a result, the present method and apparatus provides a simple and efficient means for effectively transforming the overall appearance of a conventional display merchandiser into an eye catching display which will enhance sales.

It is therefore a principal object of the present invention to provide a system for changing the appearance of a display fixture.

Another object of the present invention is to provide a plurality of sheet-like members which are foldable and assemblable into a three-dimensional representation of a particular object when such sheet-like members are attached to an existing display merchandiser.

Another object of the present invention is to teach a transformation technique adaptable for use in conjunction with a wide variety of different display merchandisers wherein the overall appearance of a display unit is transformed into the representation of a particular object.

These and other objects and advantages of the present invention will become apparent to those skilled in the art after considering the following detailed specification of several representative embodiments of the present method and apparatus in conjunction with the accompanying drawings.

BRIEF DESCRIPTION OF THE DRAWINGS

For a better understanding of the present invention, reference may be made to the accompanying drawings in which.

BEST MODE FOR CARRYING OUT THE INVENTION

Figure 1:
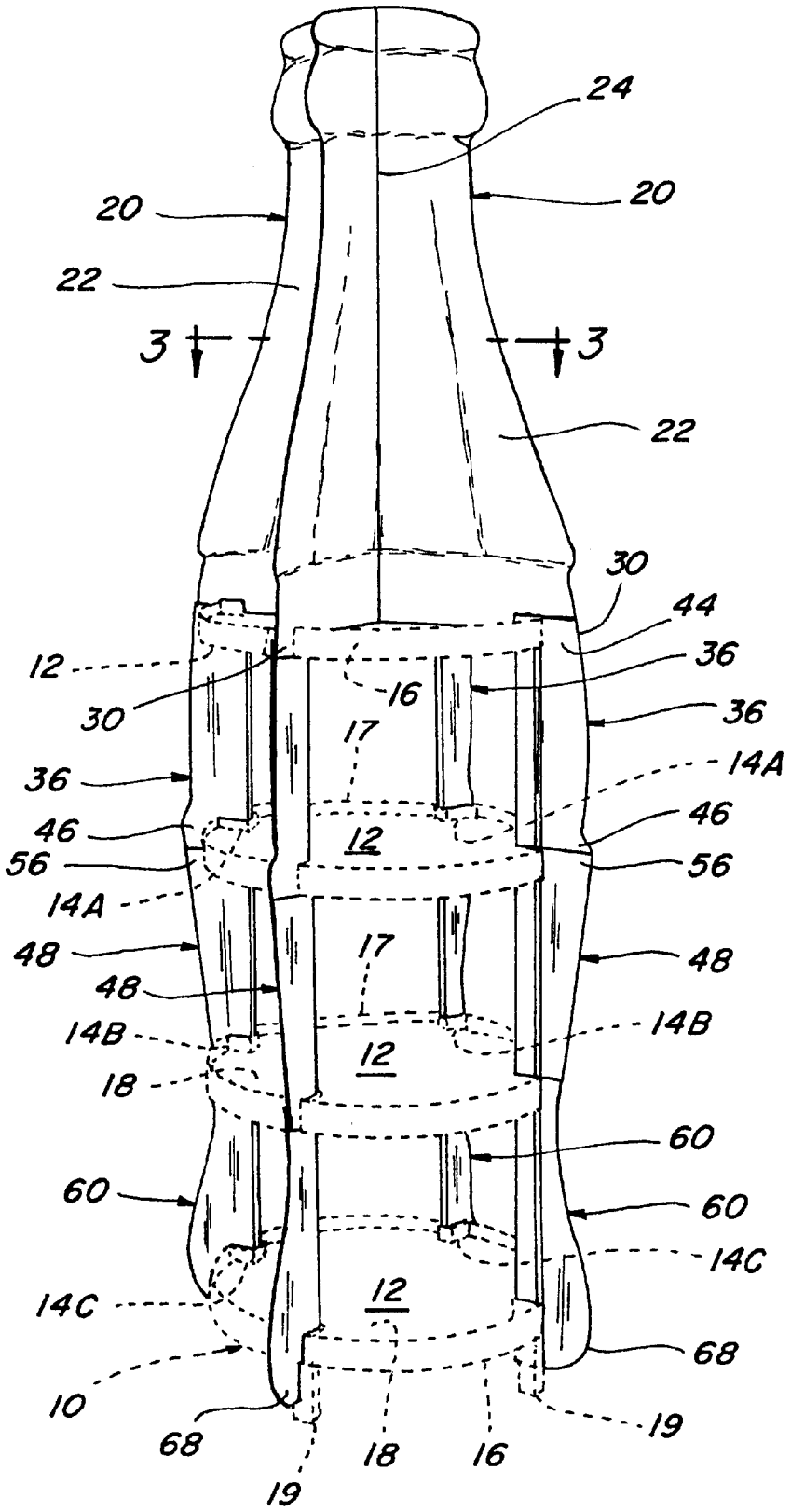
FIG. 1 is a perspective view illustrating one embodiment of the present invention attachable to a product merchandising display unit.

For purposes of illustration, the present invention has been shown in FIGS. 1–7 as including a plurality of sheet-like members 20, 36, 48 and 60 which are foldable and assemblable onto a modular display unit 10 so as to transform the appearance of the overall display unit 10 into a three-dimensional representation of a bottle. In similar fashion, the present invention is likewise shown in FIGS. 8 and 9 as including a plurality of sheet-like members 76, 78 and 82 which are attachable to a differently styled modular display unit 70 so as to transform the appearance of the display unit 70 into a three-dimensional representation of a spaceship. Although the sheet-like members 20, 36, 48 and 60 as well as the sheet-like members 76, 78 and 82, when assembled onto the particular display units 10 and 70 illustrated in the drawings, yield a three-dimensional representation of a particular object such as the bottle illustrated in FIGS. 1–7 and the spaceship illustrated in FIGS. 8 and 9, it is recognized and anticipated that the sheet-like members of the present invention can be shaped and configured so as to produce the appearance of any particular object. In this regard, although the present invention will be described based upon the specific representations illustrated in FIGS. 1–9, it is recognized and anticipated that any other envisioned representation can be achieved based upon the teachings of the present invention.

Referring to the drawings more particularly by reference numbers wherein like numerals refer to like parts, number 10 in FIG. 1 identifies one embodiment of a typical modular display merchandiser 10 commonly used in a wide variety of different display applications. The display merchandiser 10 includes a plurality of shelf members 12 and a plurality of elongated upright support members 14A, 14B and 14C positioned between the spaced apart shelf members 12 for vertically stacking the same one above the other as shown in FIG. 1. Each of the shelf members 12 is designed to support and merchandise products positioned thereon such as bottled and canned soft drink products and the like, and each shelf 12 includes a wall portion 16 extending about the perimeter thereof as well as a floor portion 18. Although each shelf member 12 illustrated in FIG. 1 is generally circular in shape, it is recognized that the present invention is equally adaptable for use with a multiplicity of differently shaped shelf members, for example, square, rectangular, hexagonal, or some other configuration, without impairing the teachings of the present invention. It is also recognized that the present invention is likewise adaptable for use with a multiplicity of differently shaped and configured modular display units as will be hereinafter further explained.

Figure 3:
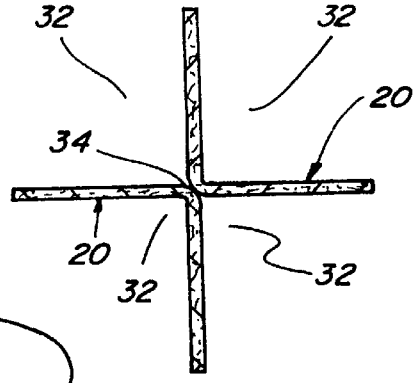
FIG. 3 is a cross-sectional view taken along line 3—3 of FIG. 1.
Figure 2:
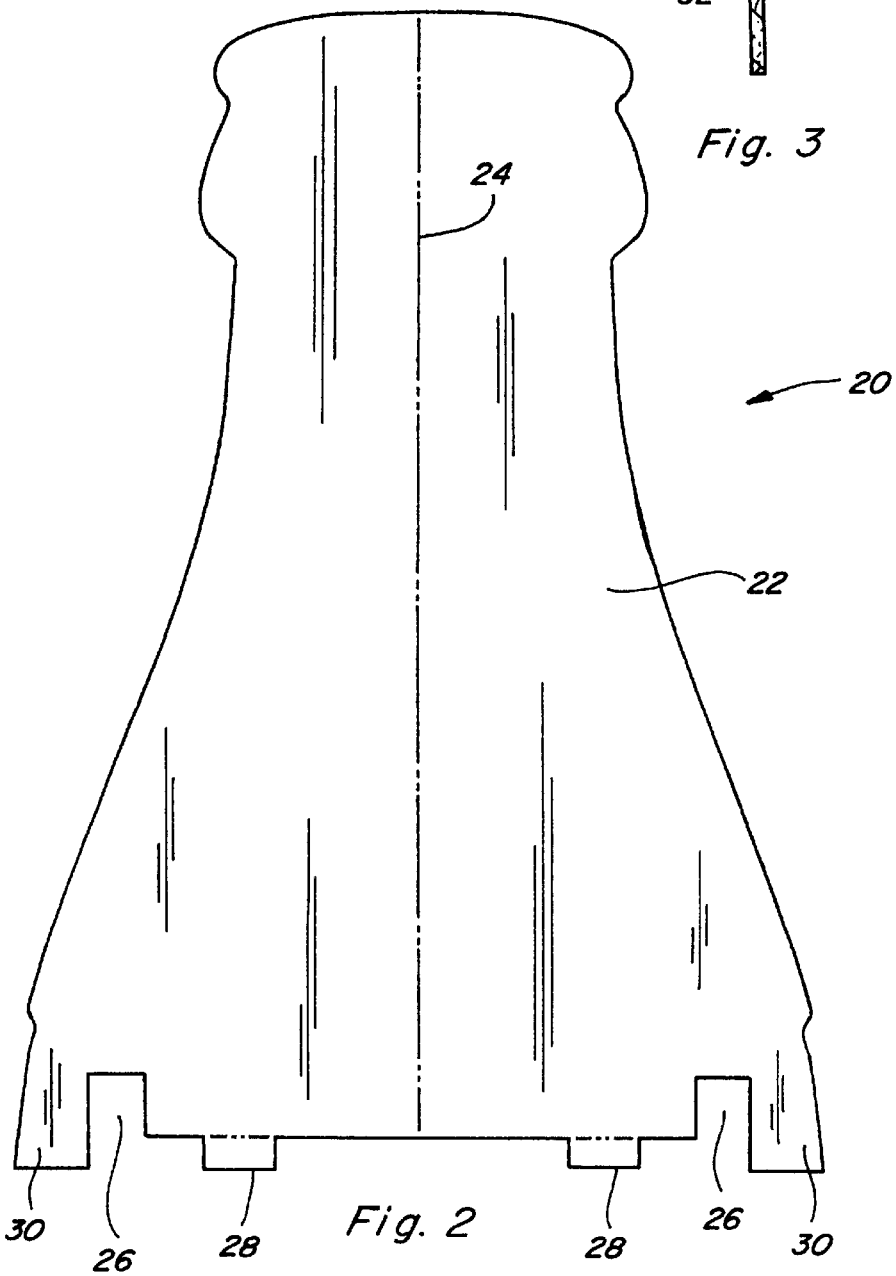
FIG. 2 is a front elevational view of one of the sheet-like members which is attachable to the uppermost shelf member of the display unit illustrated in FIG. 1.

The present invention resides in the use of a plurality of sheet-like members such as the members 20, 36, 48 and 60, which sheet-like members are foldable and attachable to various portions of the display merchandiser 10 as illustrated in FIG. 1. Referring to FIG. 2, the sheet-like member 20 is shown in its initial flat form as a sheet 22 made of a board type material which is shaped and dimensioned so as to represent the upper portion of a soda bottle. The sheet member 20 is scored or otherwise foldable along the line 24 and includes a pair of cutout portions or slots 26 as well as at least a pair of tab members 28. The slots 26 are sized and dimensioned so as to fit over any upstanding lip portion 17 associated with wall portion 16 when the sheet-like member 20 is folded along line 24 into a 90° orientation as best illustrated in FIGS. 1 and 3. When so folded and positioned on top of the uppermost shelf member 12 of display merchandiser 10, the plurality of tabs 28 are foldable or bendable so as to lie flush and mate with the floor portion 18 associated with uppermost shelf member 12. In this regard, the mating surface of the respective tab members 28 will typically include some type of adhesive material for attaching to the floor portion 18 so as to hold the member 20 in proper position on top of the upper shelf member 12 as illustrated in FIG. 1, although any suitable means for accomplishing this task such as using cooperatively engagable VELCRO fastening means may likewise be utilized. It is also recognized and anticipated that any plurality of tab members 28 may be utilized with member 20 in order to provide a secure attachment with the uppermost shelf member 12. Also, the tab members 28 may be folded in an alternating manner such that some tab members extend adjacent one side portion of the sheet member 20 whereas other tab members extend adjacent the opposite side portion of the sheet member 20. The pair of slots 26 also function to secure the sheet member 20 to the uppermost shelf 12 and such slots help maintain the member 20 in an upright stable position on top of shelf member 12. When properly positioned and attached as shown in FIG. 1, the downwardly extending lower flange portions 30 of sheet member 20 overhang the outer surface of shelf wall portion 16 adjacent a corresponding upright support member 14A as best shown in FIG. 1. The flange portions 30 will mate with other flange portions such as the portions 44 as will be hereinafter explained.

As best illustrated in FIG. 1, two of the sheet-like members 20 are folded and positioned in abutting relationship to each other as illustrated in FIG. 3 in order to create the representation or illusion of the upper portion of a soda bottle. In this regard, the folded portion of each sheet member 20 along substantially the entire longitudinal length of fold line 24 is placed in abutting relationship to each other so as to form an X or cross pattern as shown in FIG. 3. Both sheet-like members 20 are secured to the uppermost shelf member 12 as previously explained using the tab portions 28 and both the front and back surfaces of each respective member 20 may include graphics which further depict the appearance of a soda bottle and enhance the illusion when viewed at any angle relative to the overall display unit 10. As best shown in FIG. 3, when the pair of sheet-like members 20 are assembled as described and illustrated, four separate, segregated areas 32 are formed adjacent the uppermost shelf member 12 between the respective members 20 which not only contribute to the overall shape and contour of the bottle representation, but such segregated areas 32 provide space on the uppermost shelf member 12 for displaying and merchandising products. It is also recognized and anticipated that additional attachment means may likewise be utilized to attach the sheet-like members 20 to the uppermost shelf member 12. Such additional means may include a wide variety of different types of clip members or slotted flange members which could engage either the upper or lower edge surfaces of the abutting sheet-like members 20 in the area 34 illustrated in FIG. 3. Such clip type members could merely frictionally engage the respective four portions of the members 20, or such fastening members could be adhesively engaged therewith. Still further, if a clip-type member is utilized with the lower edge portion of the respective members 20, such member could likewise be attached directly to the shelf floor portion 18 so as to add still further stability and strength to the arrangement of the members 20 adjacent the uppermost shelf member 12. Other fastening arrangements and attachment means may likewise be utilized in order to accomplish this task.

Figure 4:
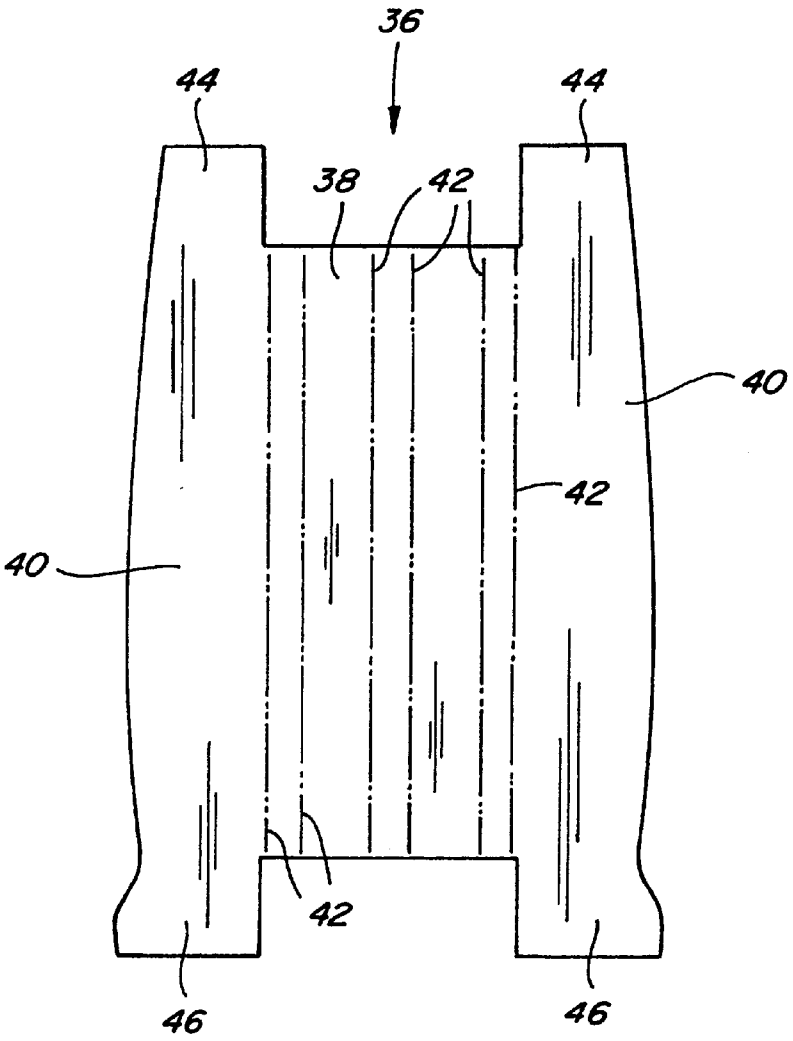
FIG. 4 is a front elevational view of one of the sheet-like members which is attachable to any one of the upper elongated support members of the display unit illustrated in FIG. 1.

FIG. 4 illustrates another sheet-like member 36 which is foldable and attachable to any one of the upper support members 14A. Like the members 20, the sheet-like member 36 is shown in its initial flat form as being a sheet of a board type material which is shaped and configured so as to represent a portion of the overall bottle contour as best illustrated in FIG. 1. The member 36 includes a substantially rectangular center portion 38 having an elongated portion 40 associated with each opposite side thereof. The center sheet portion 38 includes a plurality of score or fold lines 42 for facilitating the folding of the center portion 38 about the upper support member 14A such that the elongated side portions 40 will mate with each other as will hereinafter explained with respect to FIG. 7. When positioned around the upright support member 14A, the elongated portions 40 will mate with each other and will be adhesively or otherwise joined together such that the elongated portions 40 will lie in substantial alignment with the flange portions 30 associated with the members 20 positioned thereabove. In this regard, the end flange portions 44 and 46 associated with each respective elongated side portion 40 are shaped and designed so as to extend over at least a portion of the shelf wall portion 16 associated with the shelf members 12 positioned above and below the respective support members 14A so as to mate and/or overlap with adjacent flange members such as the flange members 30 associated with the sheet-like members 20 to cover the space occupied by the respective shelf members between the respective upright support members.

Figure 5:
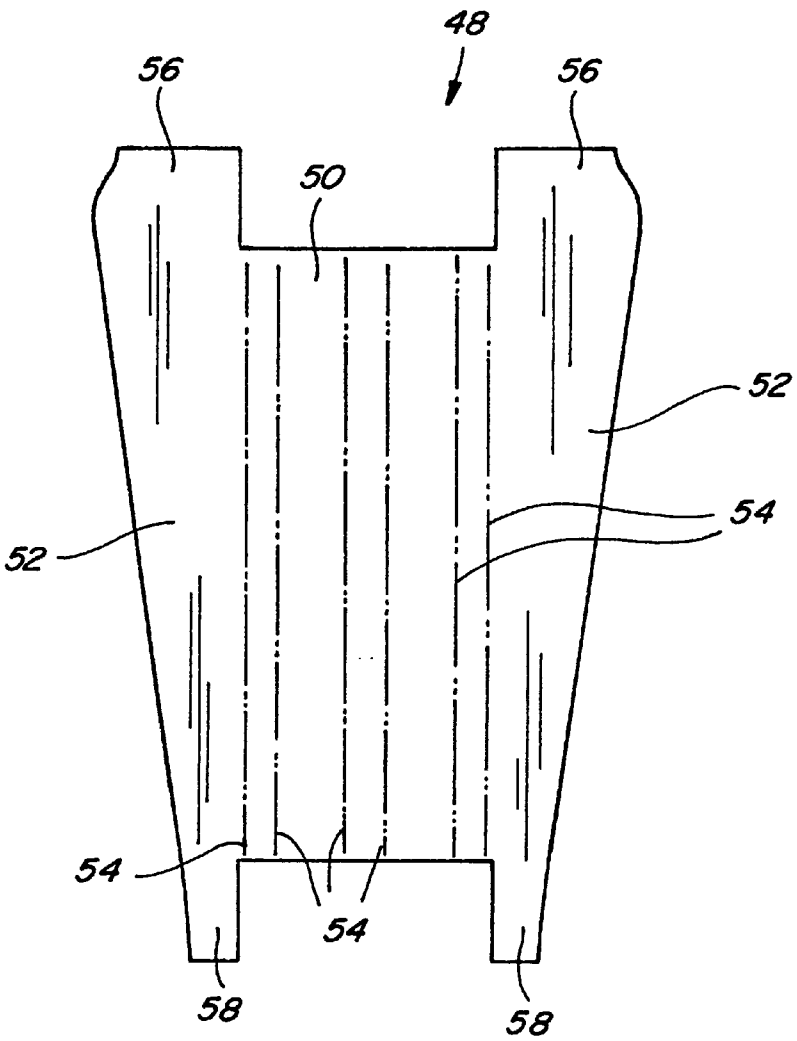
FIG. 5 is a front elevational view of one of the sheet-like members which is attachable to any one of the intermediate elongated support members of the display unit illustrated in FIG. 1.
Figure 7:
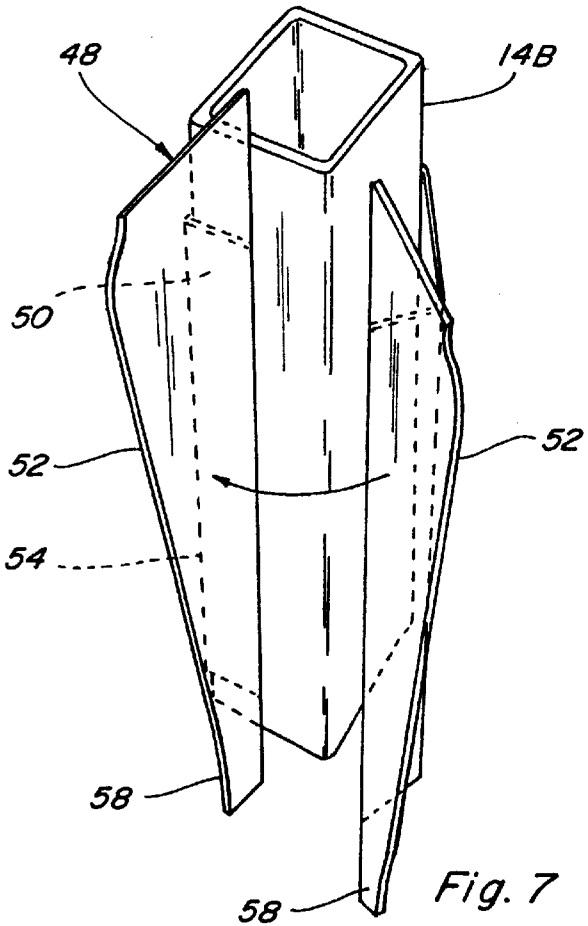
FIG. 7 is a perspective view illustrating one method of attaching the sheet-like member of FIG. 5 to one of the intermediate elongated support members.

FIG. 5 illustrates the shape and configuration of sheet-like member 48 which is foldable and assembable around any one of the intermediate support members 14B as illustrated in FIG. 1. Here again, like member 36, sheet-like member 48 is shown in its initial flat form as being a sheet of a board type material which is shaped so as to represent another portion of the overall bottle contour illustrated in FIG. 1. The member 36 includes a central portion 50 having an elongated portion 52 associated with each opposite side thereof. The central sheet portion 50 likewise includes a plurality of score or fold lines 54 which enable the central portion 50 to be foldable around the support member 14B as best illustrated in FIG. 7. As shown in FIG. 7, the center portion 50 of sheet member 48 is again substantially rectangular and is dimensioned so as to encircle the upright support member 14B at least partially along the length thereof between the vertically spaced shelf members 12. When positioned around the support member 14B (FIG. 7), the respective inner surface portions of the elongated side portions 52 of member 48 mate with each other as previously explained and as illustrated in FIG. 7, and the elongated side portions 52 are thereafter adhesively or otherwise attached to each other to secure the sheet-like member 48 in proper position around the support member 14B. Here again, the upper and lower elongated end flange portions 56 and 58 associated with each side portion 52 of sheet member 48 likewise extend so as to mate and/or overlap with the elongated flange portions associated with members 36 and 60. The previously discussed sheet-like member 36 illustrated in FIG. 4 is attached to any one of the support members 14A in the same manner as just explained with respect to member 48 illustrated in FIG. 7.

Figure 6:
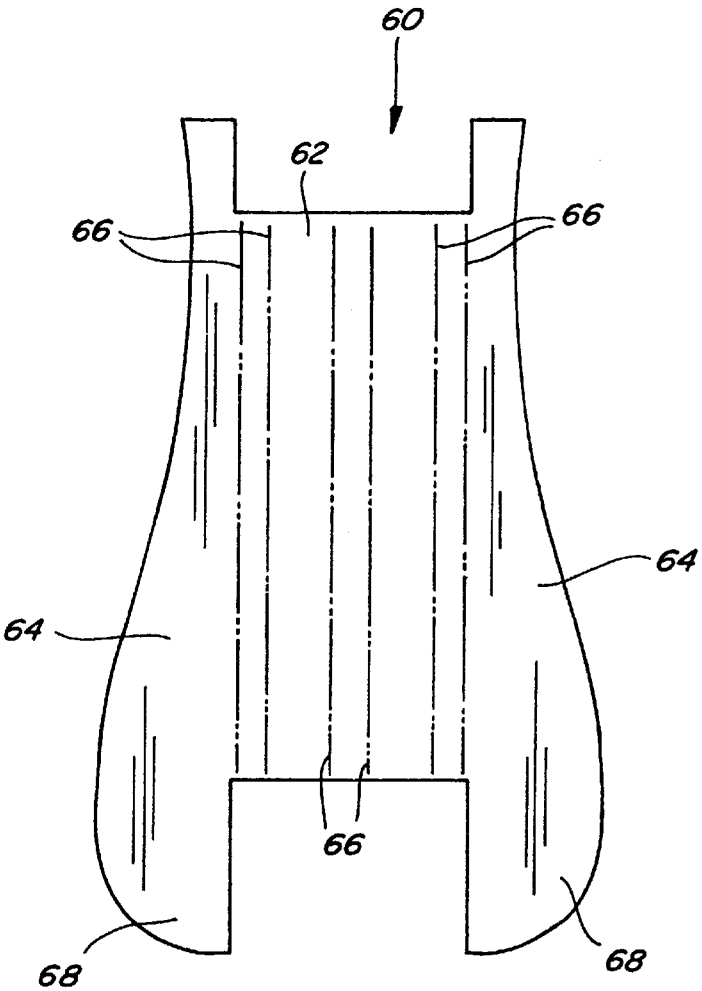
FIG. 6 is a front elevational view of one of the sheet-like members which is attachable to any one of the lower elongated support members of the display unit illustrated in FIG. 1.

Sheet-like member 60 illustrated in FIG. 6 is constructed in a manner substantially similar to sheet-like members 36 and 48 and likewise includes a central portion 62, elongated side portions 64, and a plurality of score or fold lines 66. The member 60 is attachable to the upright support members 14C in a similar manner as explained with respect to the members 36 and 48. As best illustrated in FIG. 1, when the sheet-like members 36, 48 and 60 are properly assembled and aligned with respect to one vertical grouping of support members 14A, 14B and 14C, the members 36, 48 and 60 mate and/or overlap with each other so as present the contour shape of a particular soda bottle. In this regard, the lower end flange portions 68 associated with the member 60 can be configured to overhang and extend along at least a portion of the length of the bottom leg support members 19 associated with the display unit 10. As again illustrated in FIG. 1, a set of the sheet-like members 36, 48 and 60 is attached to each vertical grouping of support members 14A, 14B and 14C so as to extend the visual representation of the bottle to all sides of the display unit 10. Although the sheet-like members 36, 48 and 60 have been disclosed and described as being foldable and attachable to a corresponding upright support member associated with display unit 10 by encircling the same as illustrated in FIG. 7, it is recognized and anticipated that a wide variety of other means for attaching the members 36, 48 and 60 to the support members 14A, 14B and 14C may be utilized as will be hereinafter further explained. In addition, it is also anticipated and recognized that the members 36, 48 and 60 may likewise be attached to other portions of the display unit 10 without departing from the sprit and scope of the present invention and without destroying the three-dimensional illusion created by the attachment of the members 20, 36, 48 and 60 to the display unit 10.

Figure 8:
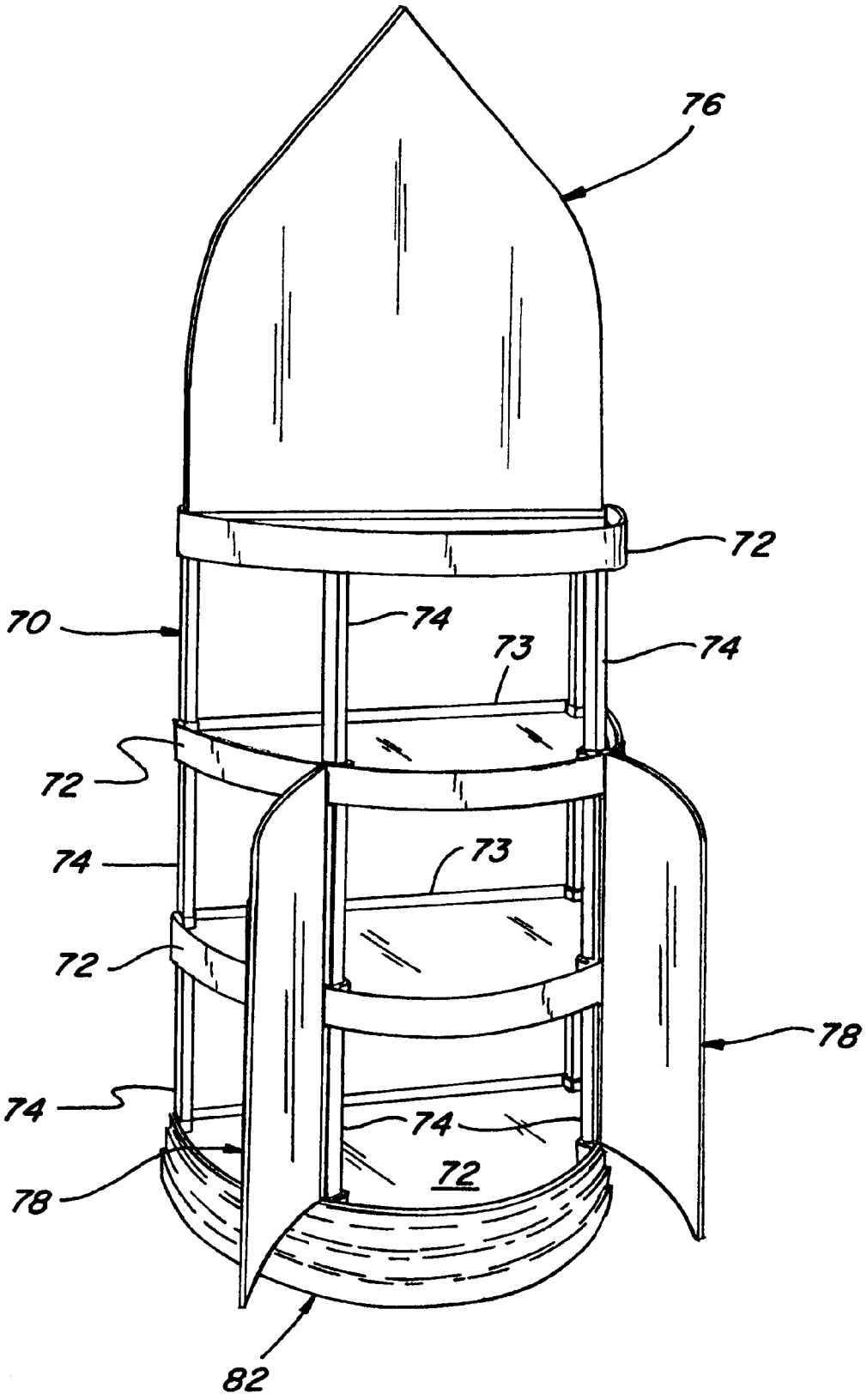
FIG. 8 is a perspective view illustrating another embodiment of the present invention attachable to a differently styled product merchandising display unit.

FIG. 8 illustrates another embodiment of the present invention which can be used in conjunction with a differently styled modular display unit 70 which includes a plurality of vertically spaced semi-circular shelf members 72 which are supported in spaced apart relationship by a plurality of upright support members 74. This embodiment of the present invention includes sheet-like members 76 and 78 as illustrated in FIG. 8, which members are attachable to the display unit 70 at particular locations thereon to achieve a three-dimensional representation of a spaceship. Sheet-like member 76 is again formed of a board type material which is shaped similar to the nose cone of a spaceship and is dimensioned so as to be attachable to the uppermost shelf member 72 as illustrated in FIG. 8. In this regard, the sheet-like member 76 can be adhesively attached to the upper shelf member 74 via the use of a plurality of bendable flange portions similar to the flange portions 28 illustrated in FIG. 2, or the member 76 could be attachable to the back wall portion 73 of the uppermost shelf member 72. Other means for attaching the sheet-like member 76 to the shelf member 72 are likewise recognized and anticipated.

Figure 9:
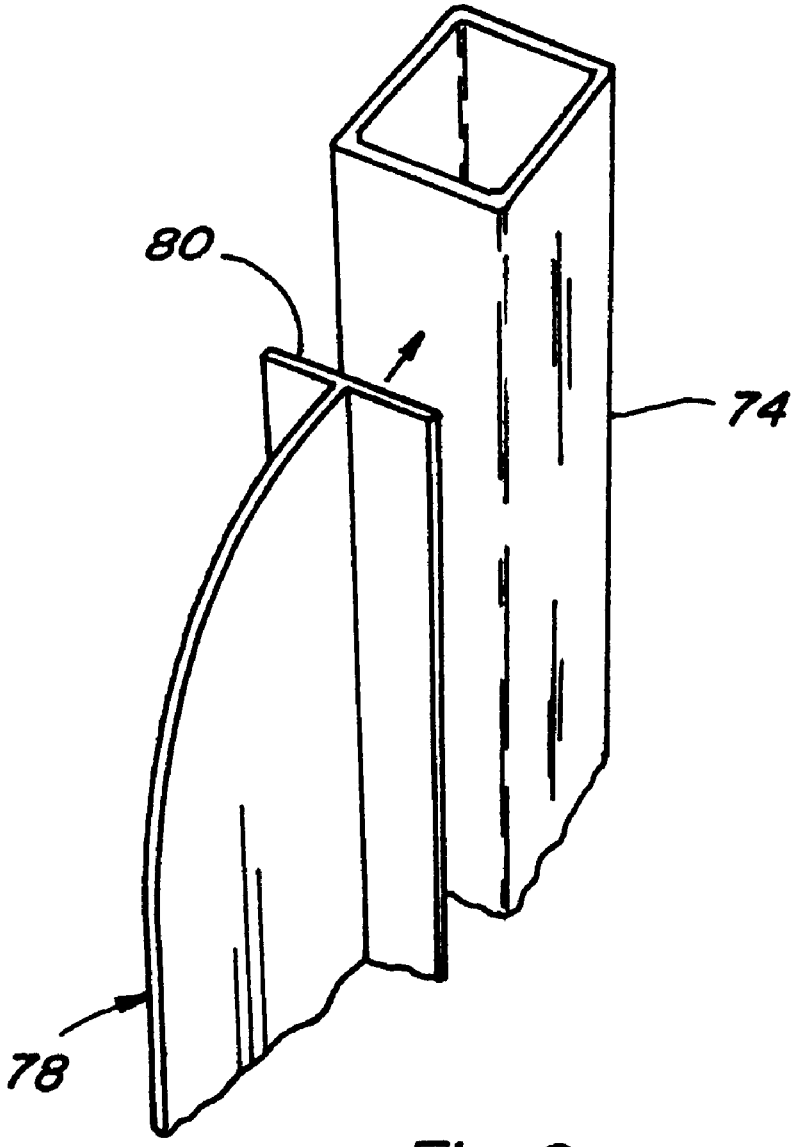
FIG. 9 is a partial perspective view illustrating another method of attaching one of the sheet-like members illustrated in FIG. 8 to an elongated support member.

Sheet-like members 78 are substantially identical in shape and configuration and are designed so as to represent the fin portions of a spaceship. Each member 78 includes a substantially flat edge flange portion 80 as best shown in FIG. 9 which is shaped and dimensioned so as to matingly engage one side portion of any one of the upright support members 74. In the embodiment illustrated in FIG. 8, each sheet-like member 78 is dimensioned so as to extend both above and below a particular intermediate shelf member 72 and such members may engage the respective upright support members 74 positioned both above and below the intermediate shelf member as illustrated in FIG. 8. In this regard, attachment of the member 78 to one or more upright support members 74 is accomplished by adhesively attaching a corresponding flange portion 80 to each of the respective members 74. It is also recognized and anticipated that the sheet-like members 78 may be attached directly to one or more of the shelf members 72, or to other portions of the overall display merchandiser 70. Similarly, a wide variety of different joinder means may be utilized in order to accomplish this task.

An optional sheet-like member 82 constructed of a board type material may likewise be utilized to circumscribe the bottom portion of the display unit 70 as illustrated in FIG. 8 so as to simulate the nozzle portion of a spaceship. The member 82 can be attached to the bottom portion of the display merchandiser 70 by any suitable means such as by attaching the member 82 to the lowermost shelf member 72, or to the bottom leg support members (not shown) associated with the unit 70. Once the members 76, 78 and optional member 82 are attached to the display unit 70, such display unit is transformed into the appearance of a spaceship. The members 76, 78 and 82 likewise start out in an initial flat form and may be foldable and/or bendable similar to the members 20, 36, 48 and 60 so as to achieve the desired three-dimensional representation of a spaceship.

Although the initial flat form of the sheet-like members 20, 36, 48, 60, 76, 78 and 82 illustrated in FIGS. 1–9 are of a particular size and configuration so as to represent either a soda bottle or a spaceship, the present invention is not limited to any particular shape in that the sheet-like members can be shaped and configured so as to represent any three-dimensional object when assembled onto a particular display unit such as a soda bottle, a spaceship, animal or cartoon characters, and so forth. Thus, in order to be accommodated by display units of varied planned designs, the sheet-like board type members 20, 36, 48, 60, 76, 78 and 82 can be produced in a wide variety of shapes and configurations with attendant variations in size, design and the particular means utilized to attach such members to the particular display unit in question. Also, regardless of the overall shape and design of any particular sheet-like member, the score or fold lines associated with any such member could likewise be in greater or lesser numbers as the fold lines 42, 54 and 66 described with respect to the members 36, 48 and 60 and such fold lines could run in different directions depending upon the size and shape of the upright support members to which such sheet-like members are attached. For example, although the support members 14A, 14B, 14C and 74 illustrated in the accompanying drawings are substantially square or rectangular in shape, the present sheet-like members are equally adaptable for attachment and/or engagement with differently shaped and configured support members such as support members having a triangular, circular, octagonal, or any other polygonal shape. The particular shape of the upright support members will dictate the number of score or fold lines utilized with respect to any particular sheet-like member. In the case of a circular support member, no fold lines will be necessary as the sheet-like members can be easily contoured to the shape of the circular member. Therefore, it will be appreciated by those skilled in the art that the present method and sheet-like members for transforming the appearance of a particular display unit into a three-dimensional representation of a particular object can be produced in a wide variety of different shapes suitable and adaptable for use with an equally wide variety of modular display units.

Materials of construction suitable for use in forming the sheet-like members of the present invention comprise any of the known types of both corrugated and uncorrugated board material of varying stock and weight. In addition, such board material could be from a wide variety of paper materials, or a wide variety of plastics so long as such materials demonstrate the requisite flexibility for folding and bending along possible score or fold lines as discussed above.

Thus, there has been shown and described several embodiments of a novel method and apparatus for changing the appearance of a display merchandiser into a three-dimensional representation of a particular object, which method and apparatus fulfill all of the objects and advantages sought therefor. Many changes, modifications, variations and other uses and applications of the present invention will, however, become apparent to those skilled in the art after considering this specification and the accompanying drawings. All such changes, modifications, variations and other uses and applications which do not depart from the spirit and scope of the invention described herein are deemed to be covered by the invention which is limited only by the claims which follow.

What is claimed is:

1. A method of transforming the appearance of a display merchandiser into a three-dimensional representation of a particular object other than the three-dimensional representation of the display merchandiser itself, said display merchandiser including a plurality of shelf members and a plurality of upright support members, the method comprising the steps of:

(a) selecting the shape of a particular object other than the shape of the display merchandiser itself into which the appearance of the display merchandiser will be transformed;

(b) forming a plurality of sheet-like members which are separate and apart from the display merchandiser itself and which will be representative of the appearance of the particular object selected in step (a) above when said sheet-like members are attached to the display merchandiser; and (c) attaching said sheet-like members to various portions of the display merchandiser in such a manner that said sheet-like members interact with each other and with the display merchandiser to transform the appearance of the display merchandiser into a three-dimensional representation of the object selected in step (9) above.

2. The method of claim 1 wherein at least one of said sheet-like members is attachable to at least one of the upright support members associated with the display merchandiser.

3. The method of claim 2 wherein said at least one sheet-like member which is attachable to at least one of the upright support members includes a portion which is foldable so as to at least partially encircle the upright support member when attached thereto.

4. The method of claim 1 wherein at least one of said sheet-like members is attachable to at least one of the shelf members associated with the display merchandiser.

5. The method of claim 4 wherein said at least one sheet-like member is attachable to the uppermost shelf member associated with the display merchandiser.

6. The method of claim 5 wherein said at least one sheet-like member which is attachable to the uppermost shelf member includes at least two foldable tab portions for engaging the shelf member.

7. A method of changing the appearance of a product merchandising display unit so as to resemble the appearance of a particular object wherein the product merchandising display unit includes a plurality of shelf members and a plurality of elongated support members, the product merchandising display unit having a specific appearance associated therewith, the method comprising the steps of:

(a) selecting the appearance of the particular object wherein said selected appearance is different from the specific appearance of the product merchandising display unit itself;

(b) forming a plurality of sheet-like members other than the shelf members and elongated support members associated with the product merchandising display unit which will be representative of the appearance of the particular object selected in step (a) above when said sheet-like members are assembled onto the product merchandising display unit;

(c) attaching at least one of said sheet-like members to the uppermost shelf member associated with the product merchandising display unit; and (d) attaching at least some of said sheet-like members to at least some of the elongated support members associated with the product merchandising display unit in such a manner that said sheet-like members interact with the product merchandising display unit to resemble the appearance of the particular object selected in step (a) above.

8. The method of claim 7 wherein each of the plurality of shelf members associated with the product merchandising display unit includes a floor portion, the at least one sheet-like member which is attachable to the uppermost shelf member further including a plurality of foldable tab portions for engaging the floor portion of the uppermost shelf member.

9. The method of claim 7 wherein the uppermost shelf member includes a side wall, the at least one sheet-like member which is attachable to the uppermost shelf member further including at least one slotted portion for engaging the side wall of the uppermost shelf member.

10. The method of claim 7 wherein the sheet-like members which are attachable to at least some of the elongated support members each includes portions which are foldable so as to encircle an elongated support member when attached thereto.

11. The method of claim 7 wherein each of the sheet-like members which is attachable to an elongated support member includes a portion which is adhesively attachable to at least a portion of the elongated support member.

12. The method of claim 7 wherein at least portions of some of said sheet-like members mate with portions of at least some of said other sheet-like members when said sheet-like members are attached to the product merchandising display unit.

13. The method of claim 7 wherein at least portions of some of said sheet-like members overlap portions of at least some of said other sheet-like members when said sheet-like members are attached to the product merchandising display unit.

14. The method of claim 7 wherein at least some of said sheet-like members are attachable to more than one elongated support member.

15. The method of claim 7 wherein the appearance of the particular object selected in step (a) is that of a soda bottle.

16. The method of claim 7 wherein the appearance of the particular object selected in step (a) is that of a spaceship.

17. The method of claim 7 wherein the elongated support members are substantially square in cross-sectional shape.

18. The method of claim 7 wherein the elongated support members are substantially circular in cross-sectional shape.

19. In a product merchandising display unit having a plurality of shelf members vertically assembled in spaced apart relationship one above the other and a plurality of elongated support members connecting vertically spaced pairs of shelf members, the improvement comprising:

a plurality of sheet-like members other than the shelf members and support members forming the product display merchandising unit, said plurality of sheet-like members being shaped and dimensioned to interact with the product merchandisingdisplay unit to present an appearance other than the appearance of the product merchandising display unit itself which is representative of a particular object when said sheet-like members are attached to selected portions of the product merchandising display unit, each of said sheet-like members being configured to represent the appearance of only a portion of the particular object, and means for attaching said plurality of sheet-like members to selected portions of the product merchandising display unit in such a manner that said sheet-like members transform the overall appearance of the display unit into a three-dimensional representation of the particular object.

20. The improvement of claim 19 wherein at least one of said sheet-like members is attachable to at least one of the shelf members associated with the product merchandising display unit.

21. The improvement of claim 20 wherein at least one of said sheet-like members is attachable to the uppermost shelf member associated with the product merchandising display unit.

22. The improvement of claim 21 wherein said at least one sheet-like member includes at least one tab portion, said tab portion being positioned and located so as to engage a portion of the uppermost shelf member, said at least one tab portion being attachable to the engaged portion of the uppermost shelf member so as to hold said sheet-like member in proper position relative thereto.

23. The improvement of claim 22 wherein the uppermost shelf member includes a side wall, said at least one sheet-like member being bendable and including at least one slotted portion for engaging the side wall of the uppermost shelf member.

24. The improvement of claim 19 wherein at least some of said sheet-like members are attachable to at least some of the elongated support members associated with the product merchandising display unit.

25. The improvement of claim 24 wherein said sheet-like members which are attachable to the elongated support members each include a portion which is foldable so as to substantially encircle the support member when said sheet-like member is attached thereto.

26. The improvement of claim 24 wherein each of said sheet-like members which is attachable to an elongated support member includes a portion which is adhesively attachable to at least one surface portion of the elongated support member.

27. The improvement of claim 19 wherein said means for attaching said plurality of said sheet-like members to selected portions of the product merchandising display unit includes at least a portion of each of said sheet-like members being adhesively attachable to a portion of the product merchandising display unit.

28. A display merchandiser for accommodating the storage of products positioned thereon comprising a plurality of shelf members, a plurality of elongated support members for supporting said shelf members, and a plurality of sheet-like members attachable to said display merchandiser, said sheet-like members being different from said plurality of shelf members and elongated support members and being shaped and dimensioned to interact with said display merchandiser and with each other to present an overall appearance which is different from the appearance of the display merchandiser itself and representative of a particular object, each of said sheet-like members being configured to represent only a portion of the overall appearance of the particular object, at least one of said sheet-like members being attachable to at least one of said shelf members, and at least one of said sheet-like members being attachable to at least one of said elongated support members.

29. The display merchandiser of claim 28 wherein portions of at least some of sheet-like members mate with each other when said sheet-like members are attached to said display merchandiser.

30. The display merchandiser of claim 28 wherein said at least one sheet-like member which is attachable to an elongated support member includes a portion which is bendable so as to substantially encircle said support member when said sheet-like member is attached thereto.

31. The display merchandiser of claim 28 wherein said at least one sheet-like member which is attachable to said elongated support member includes a portion which is adhesively attachable to at least one surface of said elongated support member.

32. The display merchandiser of claim 28 wherein said at least one sheet-like member which is attachable to one of said shelf members includes a plurality of tab portions, said tab portions being positioned and located so as to engage a portion of said shelf member so as to hold said sheet-like member in proper position relative thereto.

33. The display merchandiser of claim 28 wherein said at least one sheet-like member which is attachable to one of said shelf members includes at least one cutout portion, said sheet-like member being maneuverable relative to said shelf member so as to engage said cutout portion with a portion of said shelf member.

* * * * *

UNITED STATES PATENT AND TRADEMARK OFFICE

CERTIFICATE OF CORRECTION

PATENT NO. : 6,363,640 B1
DATED : April 2, 2002
INVENTOR(S) : Flum et al.

It is certified that error appears in the above-identified patent and that said Letters Patent is hereby corrected as shown below:

Column 8,
Line 61, delete "(9)" and substitute -- (a) --.

Signed and Sealed this

Third Day of September, 2002

*Attest:*

*Attesting Officer*

JAMES E. ROGAN
*Director of the United States Patent and Trademark Office*